US009550621B2

(12) United States Patent
Smits

(10) Patent No.: US 9,550,621 B2
(45) Date of Patent: Jan. 24, 2017

(54) PRESSURE CONTROL FILL VALVE

(71) Applicant: I.P.S. RESEARCH AND DEVELOPMENT B.V., Waalwijk (NL)

(72) Inventor: Frank Smits, NN Heesch (NL)

(73) Assignee: Airopack Technology Group B.V., Waalwijk (NL)

( * ) Notice: Subject to any disclaimer, the term of this patent is extended or adjusted under 35 U.S.C. 154(b) by 0 days.

(21) Appl. No.: 14/647,592

(22) PCT Filed: Nov. 27, 2013

(86) PCT No.: PCT/IB2013/060440

§ 371 (c)(1),
(2) Date: May 27, 2015

(87) PCT Pub. No.: WO2014/083511

PCT Pub. Date: Jun. 5, 2014

(65) Prior Publication Data

US 2015/0314946 A1 Nov. 5, 2015

(30) Foreign Application Priority Data

Nov. 27, 2012 (CH) ..... 2547/12

(51) Int. Cl.
*B67D 7/60* (2010.01)
*B65D 83/42* (2006.01)
(Continued)

(52) U.S. Cl.
CPC ..... *B65D 83/425* (2013.01); *B65D 83/42* (2013.01); *B65D 83/70* (2013.01); *B65B 31/00* (2013.01);
(Continued)

(58) Field of Classification Search
CPC ..... B65D 83/14; B65D 83/70; B65D 83/42; B65D 83/425; B65B 31/00; B65B 31/003; B65B 31/027; Y10T 137/7837; B67D 7/60
(Continued)

(56) References Cited

U.S. PATENT DOCUMENTS 3,454,182 A * 7/1969 Morton ..... B61F 15/22 137/513.5
3,522,900 A 8/1970 Nicholson
(Continued)

FOREIGN PATENT DOCUMENTS

EP 0227049 A2 7/1987
FR 2684647 A1 6/1993

OTHER PUBLICATIONS

International Search Report for PCT/IB2013/060440 dated Mar. 11, 2014.

*Primary Examiner* — Kevin P Shaver
*Assistant Examiner* — Andrew P Bainbridge
(74) *Attorney, Agent, or Firm* — McCormick, Paulding & Huber LLP

(57) ABSTRACT

A pressure control fill valve for a pressurized dispenser container comprises a first and second end and a base, a first and second circumferential lip. The lips enable placement of the valve in an opening of a pressurized dispenser container in first a position, where a propellant gas can be filled into the container and a second position for complete closing of the container. According to the invention, the second lip of the valve is asymmetric about its circumference. This prevents the valve from being pushed out of the opening of the container in case of high over-pressure or enlargement of the
(Continued)

opening due to a temperature increase. The invention eliminates the hazard of a loss of valve and propellant gas in case of high temperature.

7 Claims, 3 Drawing Sheets

(51) Int. Cl.

| | |
|---|---|
| ***B65D 83/70*** | (2006.01) |
| *B65B 31/00* | (2006.01) |
| *B65D 83/14* | (2006.01) |
| *B65B 31/02* | (2006.01) |

(52) U.S. Cl.
CPC ..... *B65B 31/003* (2013.01); *B65B 31/027* (2013.01); *B65D 83/14* (2013.01); *B67D 7/60* (2013.01); *Y10T 137/7837* (2015.04)

(58) Field of Classification Search
USPC ..... 222/396–397, 399, 388, 563; 53/467, 53/470–471, 473–474; 141/18, 107, 113, 141/2–3, 346, 350, 20; 137/511; 220/203.13
See application file for complete search history.

(56) References Cited

U.S. PATENT DOCUMENTS

| | | | | |
|---|---|---|---|---|
| 4,388,997 A * | 6/1983 | Grime | B05B 7/2408 | 220/203.14 |
| 4,750,314 A * | 6/1988 | Mietz | B65D 83/42 | 53/470 |
| 6,945,284 B1 * | 9/2005 | Hurd | B65D 83/42 | 141/2 |
| 7,958,919 B2 * | 6/2011 | Mackenzie | B65D 83/62 | 141/113 |

* cited by examiner

PRESSURE CONTROL FILL VALVE

CROSS-REFERENCE TO RELATED APPLICATION

This application is entitled to the benefit of and incorporates by reference subject matter disclosed in International Patent Application No. PCT/IB2013/060440, filed on Nov. 27, 2013, and Swiss Patent Application No. CH 02547, filed Nov. 27, 2012.

TECHNICAL FIELD

The invention pertains to a pressure control fill valve for a pressurized dispensing container, which allows the release of pressure in case of overpressure.

BACKGROUND OF THE INVENTION

Pressure control fill valves for pressurized dispensing containers are also known as Nickelson or Nicholson plugs. Pressurized dispensing containers typically comprise a volume for a fluid to be dispensed, such as a cream, lotion or solution, and a second, separate volume for a pressurized gas that is used to propel the fluid out of the dispensing container. When the gas is filled into its volume through an opening in the dispensing container, it is closed by inserting a plug or fill valve into the opening.

A pressure control fill valve or Nicholson plug, as described for example in U.S. Pat. No. 3,522,900, has an essentially cylindrical shape and comprises two circumferential grooves, which enable a dual-positioning of the plug within an opening. When positioned in a first position, flutes or cavities on the sidewall of the plug allow a gas to be passed through and into the container. When the plug is placed in its second position in the opening, the opening is fully sealed closed.

In case of extreme heat the propellant gas in such pressurized containers may become over-pressurized, and the container may explode. In order to prevent such hazard, fill valves or Nicholson plugs have been developed that allow a release of pressure in case of overpressure. They are used for applications with propellant gases that do not pose a threat to the environment. Such valve is disclosed for example in EP 1892198. The valve prevents over-pressurization of the gas container by leakage of over pressure gas while stopping the leakage once a given minimum pressure has been reached.

Such fill valves have the preferred ability to release overpressure. However, should the overpressure reach a certain high level or should the opening of the pressurized gas container enlarge as a result of a temperature increase, the fill valve will pop out of the opening entirely causing loss of the propellant gas and potential hazard to a user or person assembling the dispensing container.

SUMMARY OF INVENTION

A pressure control fill valve has an essentially cylindrical shape with a longitudinal axis, a first and second end, a base at the second end, and a circumferential side surface. It comprises a first circumferential lip at the first end and a second circumferential lip. One or more recesses on the side surface of the valve extend from the first end to the circumferential second lip. A cavity extends from the second through the base and along the longitudinal axis of the cylindrical shape of the valve into the inner body of the valve toward the first end. A flexible wall is arranged separating the inner cavity extending from the base and the recesses on the side surface of the valve. The flexible wall is deformable upon application of pressure and returns to its original shape when such pressure is again released.

According to the invention, the second circumferential lip is asymmetric about its circumference having a protrusion that is greater in a first portion of its circumference than in a second portion of its circumference.

The pressure control fill valve according to the invention may be placed in the opening of a pressurized propellant gas container of a pressurized dispenser container such that the edge of the opening sits between the base and the second circumferential lip In case of an over-pressure, the asymmetric valve shape enables that gas may leak out of the container via the one or more recesses on the side surface of the valve and bypass the circumferential lips of the valve. In case of an over-pressure of the gas, the asymmetry of the second circumferential lip causes the valve to be retained in the opening of the container in that the portion of the lip with the larger protrusion remains on the inner edge of the opening while the lesser protruding portion of the lip is pushed past the opening's edge. As a result the valve is tilted, where its longitudinal axis is angled with respect to the longitudinal axis of the gas container and its opening. Thereby, in the case of over-pressure and in particular of an enlargement of the opening of the container due to a temperature increase, a leakage of over-pressured gas is enabled while retaining the valve within the container opening and preventing the valve from being forced out entirely out of the container opening. Unlike the valve according to EP182198, this valve eliminates the hazard of loss of the valve and propellant gas through the opening.

In a particular embodiment of the invention, the protrusion of the second lip near the base of the valve is greater in the direction perpendicular to the longitudinal axis of the valve within a first defined circumferential section of the valve compared to the rest of circumferential sections, where this first defined circumferential section excludes the one or more recesses.

In a particular embodiment of the invention, the side of the second lip, which faces the base of the valve, extends at an angle to the base of the valve. In an exemplary embodiment, this angle is in the range up to 15°. Such angling allows easier de-molding of the valve during a molding fabrication process.

An exemplary embodiment of the asymmetric second lip and further details of the invention is described in connection with the following figures.

A pressurized dispenser container comprises a volume to contain a fluid to be dispensed and a container configured to contain a pressurized propellant gas such as air. Said container for pressurized gas has an opening through which the gas is to be filled and that is to be sealed closed. The dispenser container comprises the pressure control fill valve according to the present invention closing the gas container and allowing gas leakage in case of a temperature and pressure increase. The asymmetric shape of the valve assures that the valve remains in place at all pressures and temperatures during assembly and use of the dispenser and no pressurized gas is lost other than the gas leaked to reduce the pressure to a given supportable level.

The disclosed pressure control fill valve is suitable for pressure containers of various materials allowing pressure release in case of over-pressure due to change of the size of the opening of the container as a result of temperature change. As such, the pressure control fill valve is suitable for containers made of plastic or metal, such as aluminium.

BRIEF DESCRIPTION OF THE FIGURES

In the following, the invention is described in greater detail, by way of example, with reference to the accompanying drawings.

Like numerals in the various figures indicate same elements unless specified otherwise.

DETAILED DESCRIPTION OF PREFERRED EMBODIMENTS

Figure 1:
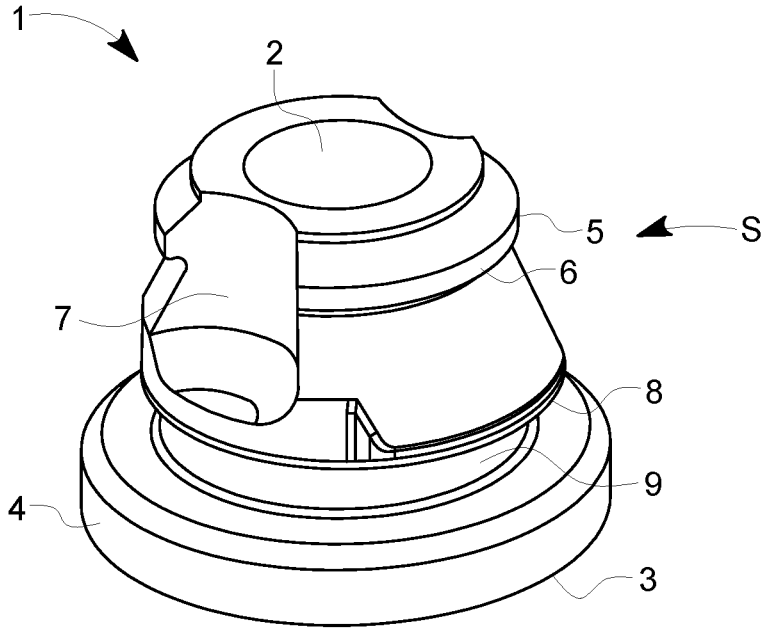
FIG. 1 shows a perspective view of an exemplary embodiment of the pressure control fill valve according to the invention.

FIG. 1 shows a pressure control fill valve 1 as it may be used to close off the opening of a propellant gas container of a pressurized dispenser container, and which will reliably leak gas in the case the gas is over-pressurized and without the risk of a removal of the valve.

The valve 1 has an essentially cylindrical shape with a longitudinal axis L extending from a first end 2 to a second end 3, a circumferential side surface S and a base 4 at the second end 2. When the valve 1 is positioned in an opening to close off a container for a propellant gas, the first or inner end 2 will be directed to the inside of the container, while the second or outer end 2 will be directed to the outside of the container.

The valve 1 comprises a base 4, having a diameter larger than the diameter of the side surface S.

In order to enable a first positioning of the valve 1 within an opening of a container, the valve 1 comprises a first lip 5 near the inner first end 2, which forms a first inner circumferential groove 6, into which a rim of an opening may be engaged. Flutes or recesses 7 are arranged evenly on the sides surface S about the circumference of the valve 1 and allow a gas to be filled into the container when the valve is placed in this first positioning. The recesses 7 extend from the first lip 5 to a second lip 8 near the second end 3, the second lip 8 forming a second groove 9 together with the base 4. Once the container has been filled with a propellant gas, such as air, the valve 1 is then pushed further into the container opening into a second positioning, such that the rim of the opening engages with the second circumferential groove 9.

According to the invention, the second lip 8 is asymmetric about its circumference having a varying degree of radial protrusion about its circumference, where the radial direction is perpendicular to the longitudinal axis. For example, the extent of its radially outward protrusion is greater in a first section 10 between the recesses 7 than in a second section 11 diametrically opposite of section 10.

Figure 2:
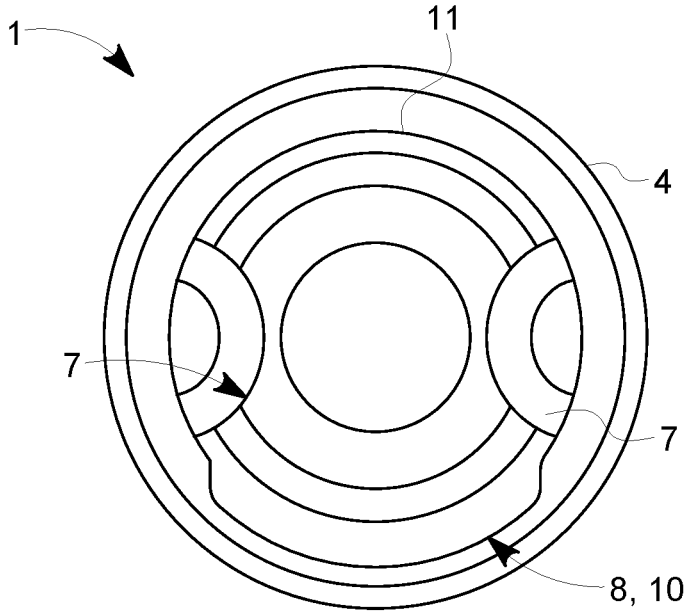
FIG. 2 shows a top view of the embodiment of the valve of FIG. 1.

The top view in FIG. 2 illustrates this asymmetry more clearly. The radial protrusion of the second lip 8 in section 10 extends up to 10% or more beyond the radial extent of the lip 8 in the other, diametrically opposite section 11.

Figure 3:
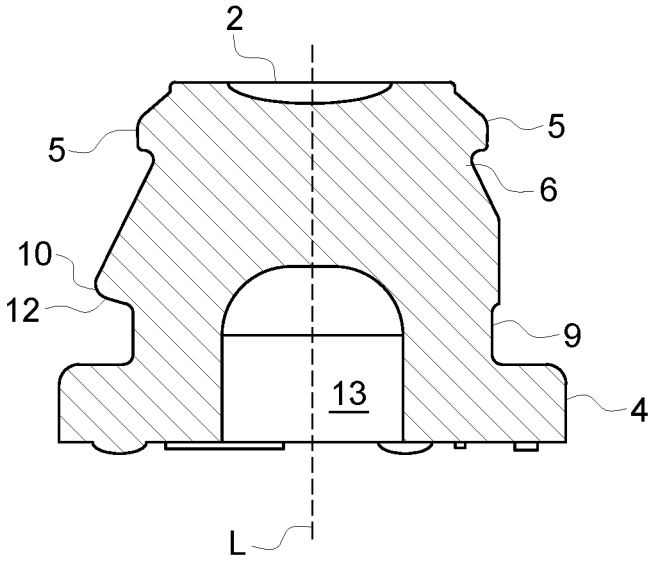
FIG. 3 shows a first section of the valve of the FIG. 1 along lines A-A.

FIG. 3 shows the asymmetry of the second lip 8 in its cross-section. The lip 8 comprises in this exemplary embodiment of the invention, a conical shape leading to a point. The underside 12 of the lower lip 8 facing the base 4 in the shown example forms an angle with the base or with the perpendicular to the longitudinal axis L of the cylindrically shaped valve. The angle may be in the range for example of 10-15°. Such angling allows easier de-molding of the element during fabrication. However, for the function of the asymmetry and the tilting of the valve in case of over-pressure, such angle is essentially not necessary. Depending on the fabrication method chosen the angle could also be 0°.

Figure 4:
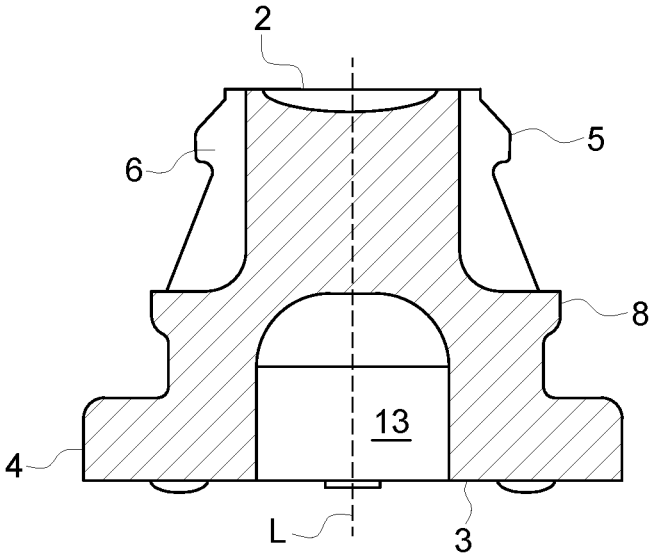
FIG. 4 shows a second section of the valve of FIG. 1 along lines B-B, FIGS. 5*a* and *b* show two positions of the valve within the opening of a gas container of a pressurized dispensing container, where

The cross-section B-B through the recesses 7 shown in FIG. 4 shows the symmetry of the valve in that cross-section.

FIGS. 3 and 4 also show in cross-section the cavity 13 in the base 4, which is essential for the enablement of a leakage of gas in case of over-pressure. The cavity 13 and recesses 7 are separated by a flexible wall, which deforms when a pressure is applied and reverts to its original shape when the pressure subsides due to the gas leakage.

Figure 5A:
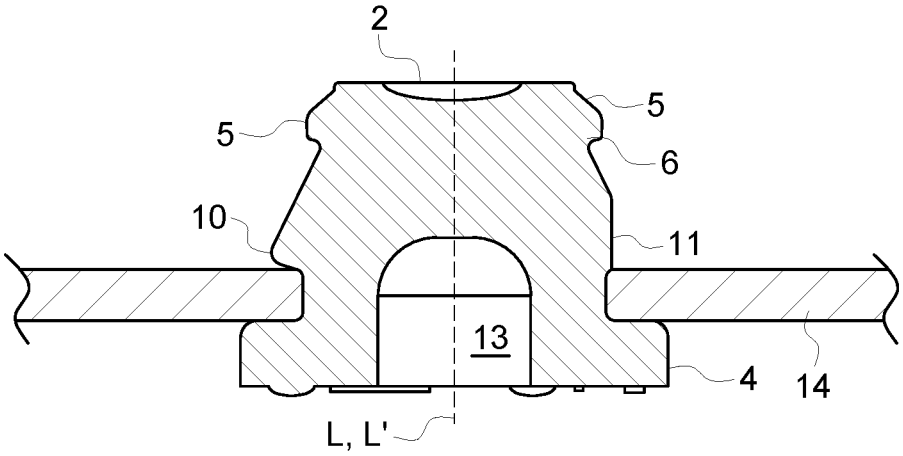
FIG. 5*a* shows the position at normal pressure and FIG. 5*b* shows the position of the valve in case of an over pressure into a tilted position.
Figure 5B:
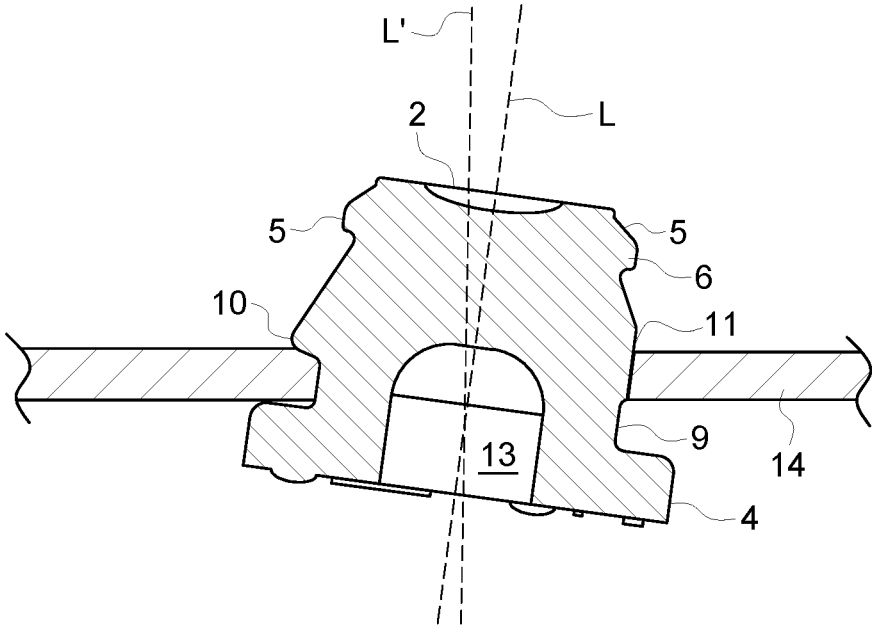

FIGS. 5*a* and 5*b* illustrate the tilting of the valve in case of an overpressure compared to its normal position. In the normal position the valve is positioned in the opening, where base 4 and second circumferential lip 10 are arranged about the edge 14 of the opening. When the pressure inside the container increases the valve is pushed out such that the smaller protrusion 11 of the second circumferential lip is pushed past the edge of the opening 14 while the larger protrusion 10 remains on the inner edge of the opening. As a result, the longitudinal axis L of the valve tilts with respect to the longitudinal axis L' of the container and its opening.

While the present invention has been illustrated and described with respect to a particular embodiment thereof, it should be appreciated by those of ordinary skill in the art that various modifications to this invention may be made without departing from the spirit and scope of the present.

What is claimed is:

1. A pressure control fill valve having an essentially cylindrical shape with a longitudinal axis, a side surface and a first end and a second end, comprising:

a base at the second end, a first circumferential lip at the first end of the valve, and second circumferential lip separated from the base by a circumferential groove, and one or more recesses on the side surface of the valve extending from the first end through the first circumferential lip and to the second circumferential lip, and a cavity having one opening arranged at the base at the second end of the valve and extending from said base toward the first end of the valve, wherein the cavity is defined by a flexible wall that separates said cavity in the base from the one or more recesses on the side surface and wherein the cavity is vacant allowing deformation of the cavity upon application of pressure with the ability of the cavity to return to said cavity's original shape when said pressure is released, wherein the second circumferential lip is asymmetric about said second circumferential lip's circumference.

2. The pressure control fill valve according to claim 1 wherein the one or more recesses comprise two recesses and wherein further the second circumferential lip protrudes to a larger degree in a direction perpendicular to the longitudinal axis within a first section of said second circumferential lip's circumference between the two recesses than in a second section of circumference opposite the first section.

3. The pressure control fill valve according to claim 1 wherein the second circumferential lip has a surface facing the base of the valve, where said surface extends at an angle to the surface of the base, the angle being in the range from 0 to 15°.

4. A pressurized dispensing container having a container for a fluid and a container having an opening and configured to contain pressurized propellant gas wherein said pressurized dispensing container comprises a pressure control fill valve according to claim 1 for closing the opening of the container for pressurized propellant gas.

5. The pressurized dispensing container according to claim 4 wherein the container is made of plastic.

6. The pressurized dispensing container according to claim 4 wherein the container is made of metal.

7. The pressurized dispensing container according to claim 6 wherein the container is made of aluminum.

* * * * *